United States Patent [19]

Venkataramani et al.

[11] 4,369,095

[45] Jan. 18, 1983

[54] ASCENSION PIPE COVER SEAT CLEANER

[75] Inventors: Rajagopala Venkataramani, Berkeley Heights; Raymond Levonaitis, Middlesex both of N.J.

[73] Assignee: Wilputte Corporation, Murray Hill, N.J.

[21] Appl. No.: 258,726

[22] Filed: Apr. 29, 1981

[51] Int. Cl.[3] ..... C10B 43/06

[52] U.S. Cl. ..... 202/241; 202/270

[58] Field of Search ..... 202/241, 270; 15/67

[56] References Cited

U.S. PATENT DOCUMENTS

| | | |
|---|---|---|
| 3,196,088 | 7/1965 | Coleman et al. . |
| 3,400,052 | 9/1968 | Olsen . |
| 3,480,514 | 11/1969 | Kinzler et al. . |
| 3,972,781 | 8/1976 | Gouye et al. . |
| 4,013,518 | 3/1977 | Miko . |

FOREIGN PATENT DOCUMENTS

| | | | |
|---|---|---|---|
| 702063 | 12/1979 | U.S.S.R. | 202/241 |
| 702064 | 12/1979 | U.S.S.R. | 202/241 |
| 755330 | 8/1980 | U.S.S.R. | 202/241 |
| 759573 | 8/1980 | U.S.S.R. | 202/241 |

*Primary Examiner*—Norman Yudkoff

*Attorney, Agent, or Firm*—Buell, Blenko, Ziesenheim & Beck

[57] ABSTRACT

The apparatus comprises a driven rotatable shaft carrying at its working end rotary scraper means and a tapered centering device in advance of the scraper means which is freely rotatable with respect thereto. The shaft end carrying the scraper means and the centering device is connected to the driven portion of the shaft by a universal joint. The scraper means are connected to the shaft behind the universal joint by several circumferentially spaced spring-loading means which normally keep the scraper means and centering device normal to the shaft but which permit those means to tilt relative to the shaft if the latter is angularly misaligned with a clean-out opening. Thus, the scraper tools are always in contact with a flat cover seat. The centering means have outwardly extending stops which make contact with the cover seat and limit the penetration of the centering means into the ascension pipe opening. The scraper tools are held in spring-loaded mountings which permit a tool to retract if or when it passes over a stop. The shaft and all elements connected to it are mounted on a carriage which is moved longitudinally on rails in a frame. The frame in turn is mounted on a larry car by power actuated lever means which move it from a retracted position on the larry car to a working position in line with an ascension pipe clean-out opening.

8 Claims, 7 Drawing Figures

ASCENSION PIPE COVER SEAT CLEANER

This invention relates to apparatus for cleaning the cover seats of clean-out openings in ascension pipes of by-product coke oven batteries. It is more particularly concerned with such apparatus suitable for mounting on a larry car which is effective even though not perfectly aligned with a clean-out opening.

The clean-out openings of ascension pipes are normally circular and are closed with circular covers which must make a gas-tight seal with the rim of the opening. The cover and cover seat may be contoured for a flat or for a tapered seal but in either case the sealing surfaces must be cleaned from time to time to remove carbon deposits which otherwise would impair the seal effectiveness. The apparatus of our invention is designed to clean flat or plane cover seats, although, it could be adapted to tapered seats.

Carbon deposits on cover seats must be removed by scraper or chisel type implements. A number of devices have been designed to clean the inside surfaces of ascension pipes by rotating elements inserted through the clean-out openings. We are aware of only one device designed to scrape cover seats, that described in U.S. Pat. No. 3,972,781 of Aug. 3, 1976 issued to Emmanuel V. Gouye, et al. The apparatus of that patent is designed to clean tapered cover seats and could only be adapted to flat cover seats if it were perfectly aligned with the clean-out opening. It is not, however, self-correcting when it is misaligned.

It is an object of our invention to provide apparatus for cleaning cover seat openings which is effective even though not perfectly aligned therewith. It is another object to provide such apparatus which is readily centered even though it is not perfectly aligned with a clean-out opening. It is another object to provide such apparatus which positions itself at the proper level for cleaning flat cover seats. It is still another object to provide such apparatus which is mounted on a larry car and retracts when it is not in use. Other objects of our invention will become evident from the description thereof which follows.

Our apparatus comprises a driven rotatable shaft carrying at its working end rotary scraper means and a tapered centering device in advance of the scraper means which is freely rotatable with respect thereto. The shaft end carrying the scraper means and the centering device is connected to the driven portion of the shaft by a universal joint. The scraper means are connected to the shaft behind the universal joint by several circumferentially spaced spring-loading means which normally keep the scraper means and centering device normal to the shaft but which permit those means to tilt relative to the shaft if the latter is angularly misaligned with a clean-out opening. Thus, the scraper tools are always in contact with a flat cover seat. The centering means have outwardly extending stops which make contact with the cover seat and limit the penetration of the centering means into the ascension pipe opening. The scraper tools are held in spring-loaded mountings which permit a tool to retract if or when it passes over a stop.

The shaft and all elements connected to it are mounted on a carriage which is moved longitudinally on rails in a frame. The frame in turn is mounted on a larry car by power actuated lever means which move it from a retracted position on the larry car to a working position in line with an ascension pipe clean-out opening.

An embodiment of our invention presently preferred by us is illustrated in the attached figures, to which reference is now made:

FIGS. 1*a* and 1*b* show a side elevation of our apparatus mounted on a larry car.

Figure 1A:
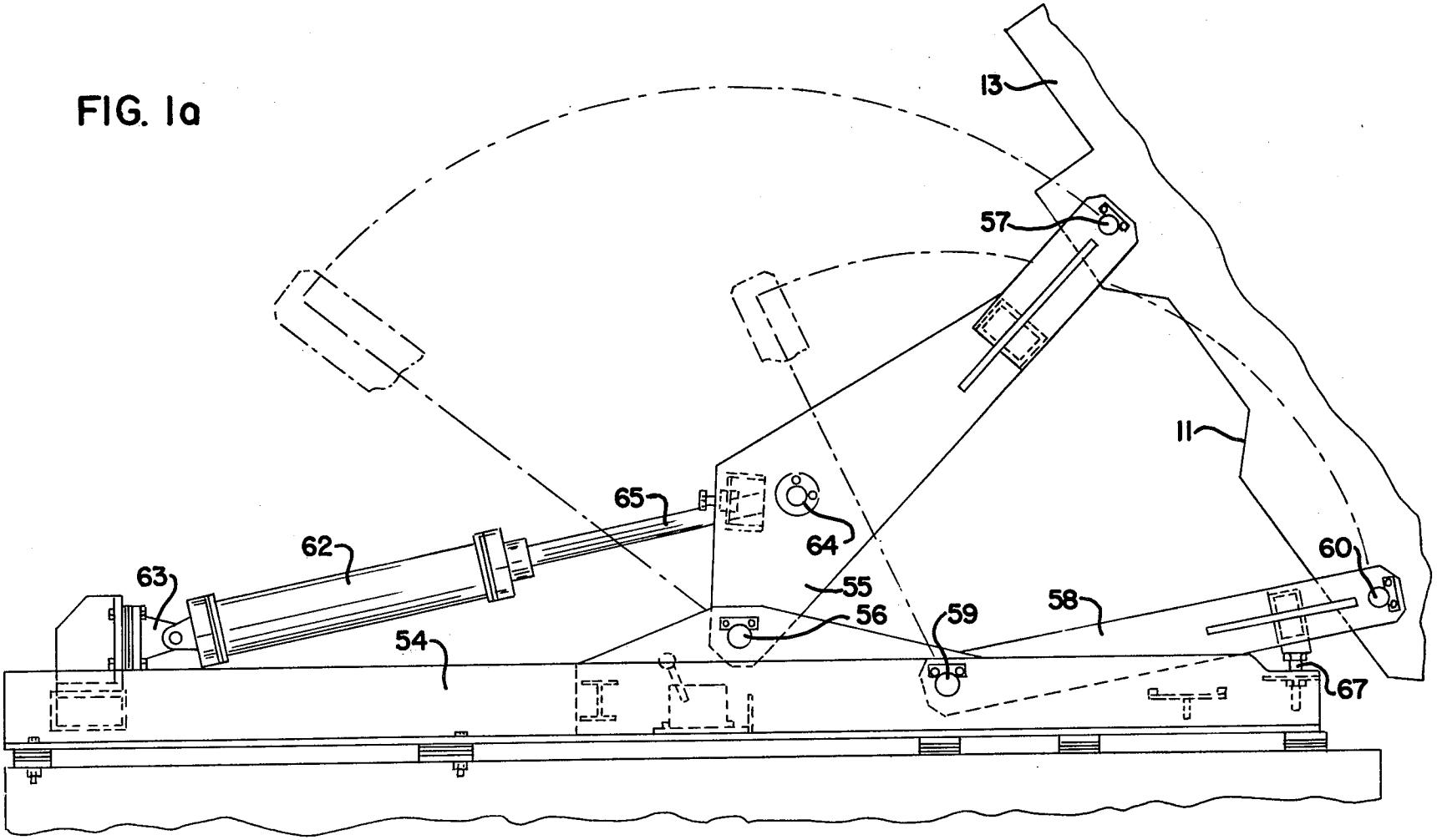
Figure 1B:
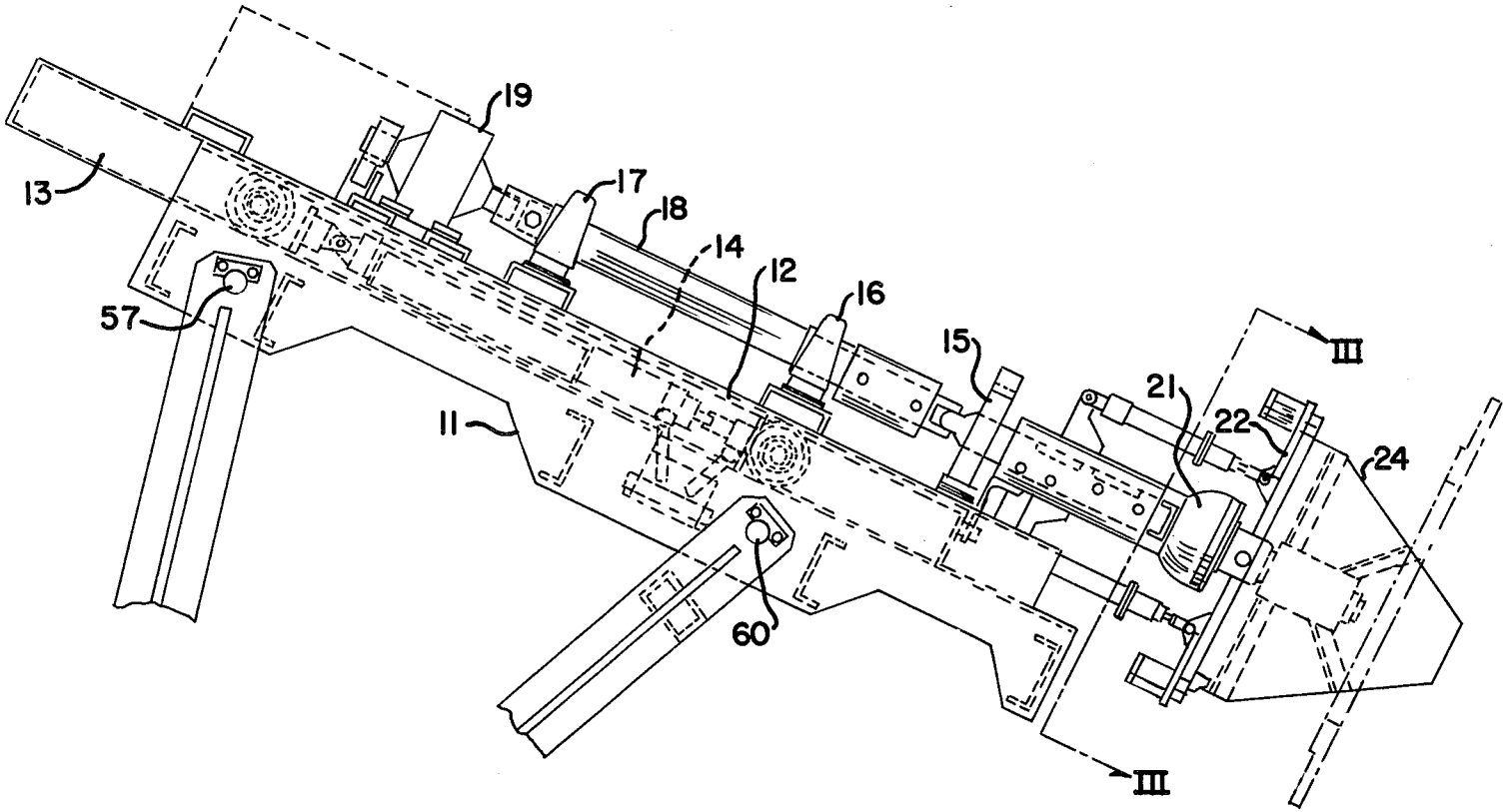
Figure 2:
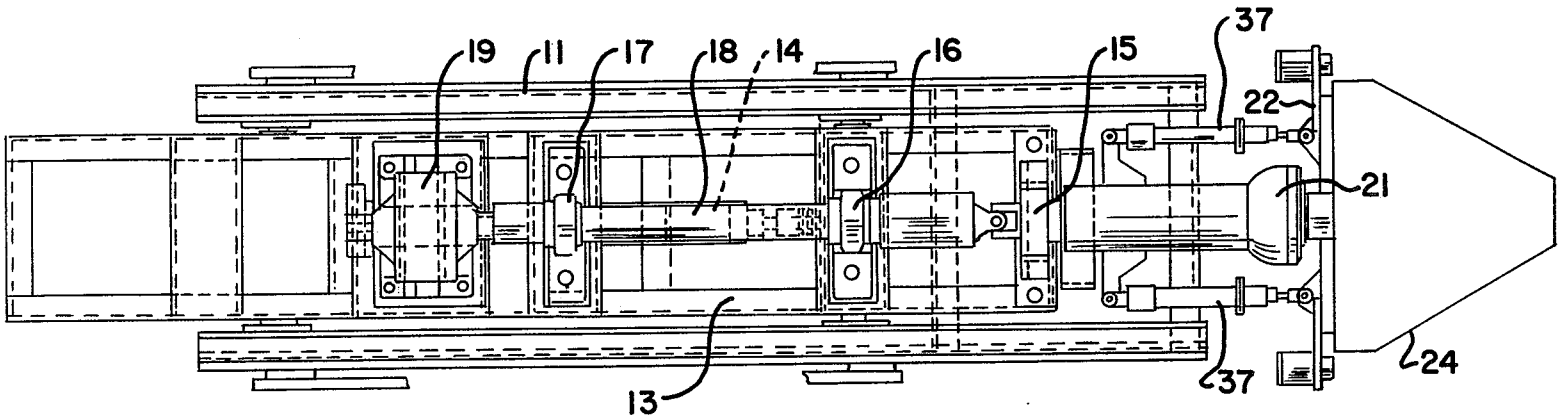
FIG. 2 is a plan of the working portion of our apparatus shown in FIG. 1*b*.

In FIG. 1*b* the working portion of our apparatus, as distinguished from the mounting portion to be described hereinafter, comprises an elongated rectangular frame 11 including spaced parallels rails 12 on which a wheeled carriage 13 moves longitudinally, the movement being effected by hydraulic cylinder 14 connected between frame 11 and carriage 13. On cross members affixed to the upper surface of carriage 13 are positioned first bearing block 15 adjacent the front end of the carriage, intermediate bearing block 16, and rear bearing block 17. In those aligned bearing blocks is journaled a shaft 18. The rear end of the shaft is connected to a motor 19 which may be hydraulic or electric and which is likewise mounted on a cross member on carriage 19. The front end of shaft 18 is connected through bell joint 21, which may be a conventional constant velocity joint, to a scraper head 22, shown in more detail in FIGS. 3 and 4, which is rotated by shaft 18. Scraper head 22, in turn, carries an axial bearing 23 on which is mounted centering means 24, also shown in more detail in FIGS. 3 and 4. Centering means 24 is freely rotatable with respect to scraper head 22.

Figure 6:
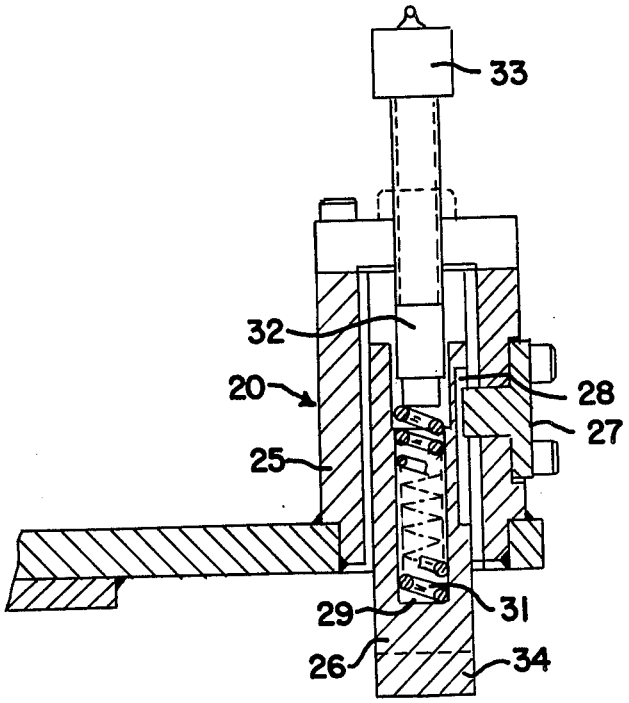
FIG. 6 is an enlarged vertical section of the spring-loaded mounting for a scraper tool.

Scraper head 22 is a four-armed spider. At the end of each arm is mounted a pair of cutting devices 20 side-by-side but with one element at a slightly lesser radius than the other element. The structure of those elements, as is shown in FIG. 6, is identical. Each element comprises a housing 25 in which a cutting tool 26 can move vertically, the movement being restricted by a stop 27 affixed to housing 25 and extending through the wall thereof and into a vertical slot 28 cut in the shank of cutting tool 26. Cutting tool 26 is formed with a vertical cavity 29 within it in which is positioned a compression spring 31 which at its upper end abuts adjustable longitudinal stop 32. Stop 32 is threaded into the top of housing 26 and is externally adjusted by turning knob 33 affixed to its outer end. The cutting end 34 of cutting tool 26 is ground to a sharp edge.

Figure 5:
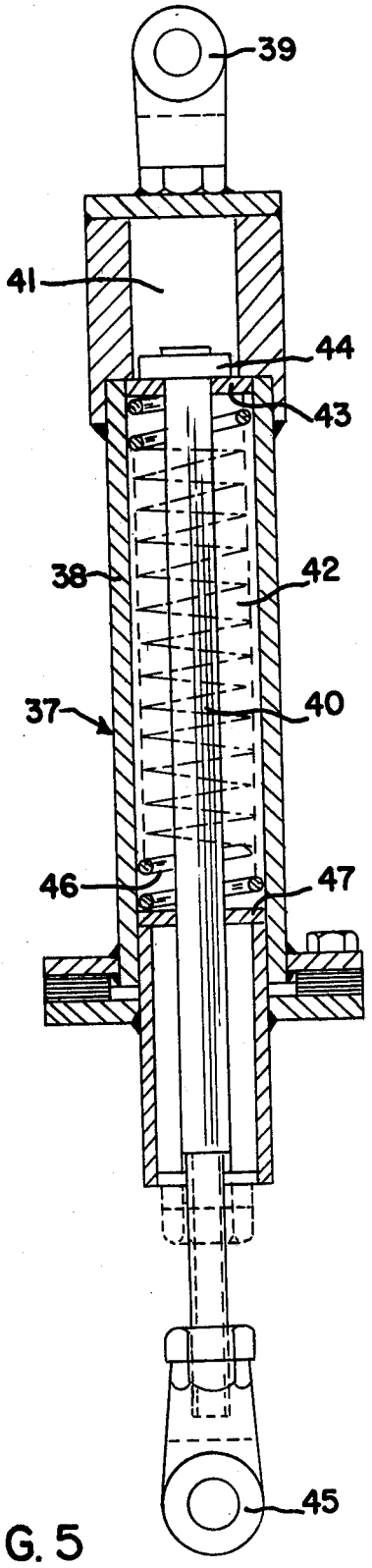
FIG. 5 is an enlarged vertical section through one of the spring-loading means connecting the scraper means to the driven shaft.

On each arm of spider 22 an upstanding lug 35 is aligned with an outwardly extending lug 36 affixed to shaft 18 above or in back of bell joint 21. Between those lugs is connected a spring-loading element 37, shown in more detail in FIG. 5. That element comprises an elongated housing 38 having a clevis 39 affixed to its upper end. Within housing 38 is an upper chamber 41 and an elongated lower chamber 42 separated therefrom by a partition 43 having a central opening of smaller diameter than either chamber. A rod 40 extends from upper chamber 41 carrying therein a head 44 of greater diameter than the opening in partition 43, through lower chamber 42, out the lower end of housing 38 and terminating in clevis 45. Within lower chamber 42 is positioned a compression spring 46, its lower end resting on partition 47 through which rod 44 passes.

Figure 3:
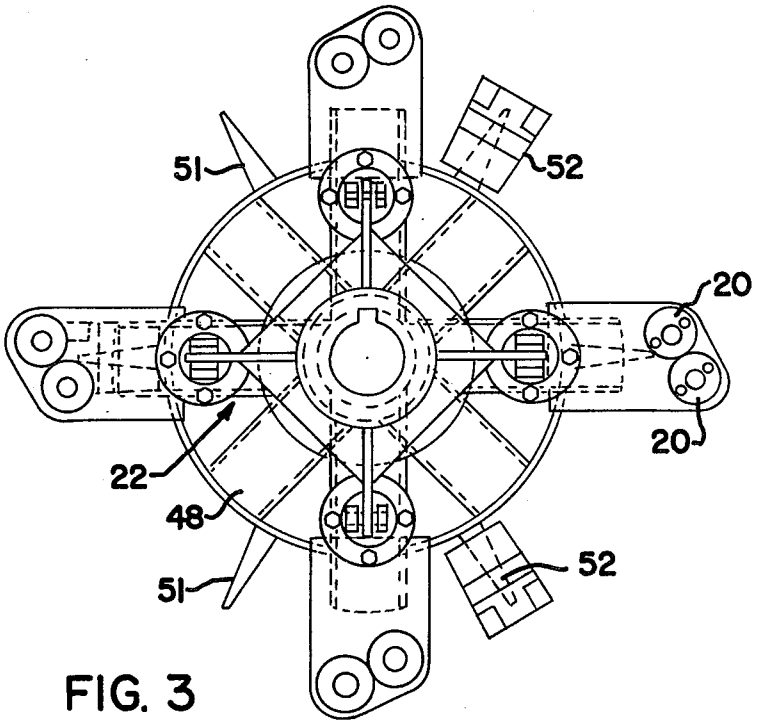
FIG. 3 is an enlarged plan of the scraper means and centering means of our apparatus taken on the plane III—III of FIG. 1*b*.
Figure 4:
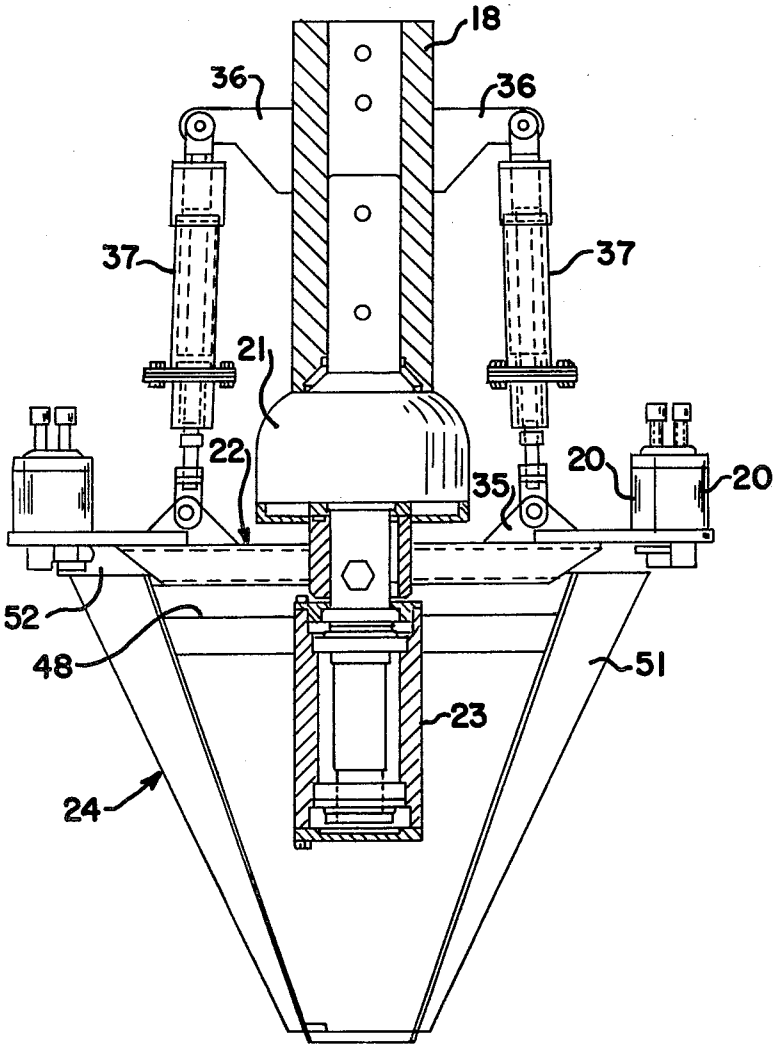
FIG. 4 is an elevation partly in section of the apparatus shown in FIG. 3.

Centering means 24 shown in detail in FIGS. 3 and 4 comprise a circular plate 48 of slightly less diameter than the clean-out opening affixed normal to the shell of bearing 23 and a much smaller lower circular plate 49 spaced therefrom, which plates are connected by circumferentially spaced vanes 51 inclined outwardly and upwardly from plate 49 to plate 48 so that when centering means 24 is rotated their outer edges describe an inverted frusto-conical surface. The upper ends of vanes 51 extend above plate 48, and alternate vanes carry stops 52 which extend outwardly beyond the tops of the vanes so as to rest on the cover seat when centering means 24 is lowered therein. Those stops cover part of the cover seat and the spring-loaded mounting of cutting tools 26 is necessary to allow the tools to be lifted by the stops if or when the tools come in contact with them. Stops 52 are shaped to facilitate such lifting.

The mounting portion of our apparatus comprises a rectangular base 54 adapted for mounting on a larry car. Intermediate the ends of base 54 a pair of lever arms 55 is pivotally mounted at one end on cross shaft 56. The other ends of those arms are pivotally connected to frame 11 near its rear end by cross shaft 57. Intermediate cross shaft 56 and an end of base 54 a second pair of lever arms 58 is pivotally mounted at one end on cross shaft 59. The other ends of those arms, which are shorter than arms 55, are pivotally connected to frame 11 near its front end by cross shaft 60. At the other end of base 54 one end of hydraulic cylinder 62 is pivotally connected to an upstanding bracket 63 affixed to base 54. The piston rod 65 of cylinder 62 is pivotally connected to the pair of lever arms 55 by a cross shaft 64 positioned intermediate the ends of those lever arms.

The operation of our apparatus is evident to a considerable extent from the foregoing description. In FIG. 1*a* our apparatus is shown in its working position in which piston rod 65 of hydraulic cylinder 62 is extended to swing lever arms 55 away from cylinder 62. Lever arms 58 swing in the same direction to a rest position on pedestal 67 at the end of base 54, but as they are shorter than arms 55, frame 11 is inclined with its rear end higher than its front end. Our apparatus is retracted by causing piston rod 65 of cylinder 62 to retract, swinging lever arms 55 and lever arms 58 toward cylinder 62 into the position shown in broken lines on FIG. 1*a*. Frame 11 is thus swung to a horizontal retracted position, also shown in broken lines. The lengths of lever arm pairs 55 and 58 are adjusted by conventional means not shown.

The lengths of lever arms pairs 55 and 58 are proportioned to incline frame 11 in its working position so that shaft 18 is normal to the nominal plane of the cover seats of the ascension pipes of the battery. The position of a cover seat is shown in broken lines on FIG. 1*b*. Hydraulic cylinder 14 is then operated to cause carriage 13 to move on rails 12 toward the ascension pipe opening until centering means 24 enter that opening. Because of manufacturing variations in the ascension pipes, and the wear and tear incidental to their constant use, cover seats of successive ascension pipes may not be in alignment with each other. Centering means 24 adapts itself to the individual clean-out opening, as bell joint 21 permits angular movement of centering means 24 with respect to shaft 18 necessary for it to enter the clean-out opening and bring scraper head 22 against the cover seat, and the spring loading elements 37 hold the scraper tools 26 against the cover seat. Upon retraction of centering means 24 from a clean-out opening the spring loading elements 37 bring it back into alignment with shaft 18. The travel of centering means 24 into a clean-out opening is limited by the stops 52 described hereinabove.

While we have shown and described a present preferred embodiment of the invention it is to be distinctly understood that the invention is not limited thereto but may be otherwise variously embodied within the scope of the following claims.

We claim:

1. Apparatus for cleaning the cover seats of openings in ascension pipes of coke oven batteries comprising frame means adapted for mounting on a larry car, a rotatable shaft journaled in said frame means and connected through a universal joint with scraper means rotated by the shaft adapted to scrape the cover seat and with tapered centering means adapted to be inserted into an ascension pipe opening, said scraper means being freely rotatable with respect to said centering means, and spring loading means fixed to the shaft and biasing the scraper means, the points of fixation to the shaft and the scraper means being on opposite sides, respectively, of the universal joint adapted to maintain the scraper means in contact with the cover seat during possible angular misalignment of the shaft with the ascension pipe opening.

2. Apparatus of claim 1 including means carried by the frame for rotating the rotatable shaft.

3. Apparatus of claim 1 in which the centering means at their shaft end have outwardly extending stops affixed to their upper surface to limit the penetration of the centering means into the ascension pipe openings and in which the scraper means which would otherwise come in contact with those stops are spring-loaded so as to be lifted by said stops.

4. Apparatus of claim 3 in which the scraper means comprise a spider, each arm of which carries an outer and an inner scraper tool, the outer tool being positioned to engage the cover seat beyond the radius of the stops affixed to the centering means.

5. Apparatus of claim 1 in which the centering means comprise a plurality of circumferentially spaced radial vanes, the outer edges of which generate an inverted frusto-conical surface when the centering means are rotated.

6. Apparatus of claim 1 in which the frame means comprise a pair of rails and a carriage mounted thereon for movement therealong longitudinally of the frame, said rotatable shaft being journaled on said carriage.

7. Apparatus of claim 6 including means carried on the frame for moving the carriage on the rails.

8. Apparatus of claim 1 including two pairs of lever arms, each pair pivoted at one end to the frame at points spaced from each other thereon and pivoted at the other end to the larry car at points spaced from each other thereon and means connected between the larry car and one pair of lever arms to swing the lever arms from a position in which the frame is parallel to the larry car to a position in which the frame is inclined to the larry car.

* * * * *